US005865046A

United States Patent [19]

Na et al.

[11] Patent Number: 5,865,046

[45] Date of Patent: Feb. 2, 1999

[54] CLOTHES WASHER HAVING A PULSATOR APPARATUS

[75] Inventors: Jae-Hyun Na; In-Su Cho, both of Kwangju, Rep. of Korea

[73] Assignee: Daewoo Electronics Co., Ltd., Seoul, Rep. of Korea

[21] Appl. No.: 904,150

[22] Filed: Jul. 31, 1997

[30] Foreign Application Priority Data

Jul. 31, 1996 [KR] Rep. of Korea ..... 1996 23113
Jul. 31, 1996 [KR] Rep. of Korea ..... 1996 31851

[51] Int. Cl.[6] ..... D06F 17/08

[52] U.S. Cl. ..... 68/23.6; 68/133; 68/134

[58] Field of Search ..... 68/23.6, 23.7, 68/133, 134

[56] References Cited

U.S. PATENT DOCUMENTS 4,444,027 4/1984 Ikeda ..... 68/23.6
4,495,784 1/1985 Ikeda ..... 68/23.6

*Primary Examiner*—Philip R. Coe
*Attorney, Agent, or Firm*—Jacobson, Price, Holman & Stern, PLLC

[57] ABSTRACT

In a clothes basket having a pulsator apparatus, the pulsator apparatus comprises a first pulsator 20 disposed above a bottom portion of a clothes basket 2 and rotated by a motor 4, and a driving gear wheel 42 provided rotatably in the first pulsator 20. Like the rotation of the driving gear wheel 42, the second pulsator 30 meshed with the gear wheel 42 rotates. Further, a ring shape idle gear 46 for guiding the rotation of the driving gear wheel is provided on the bottom portion of the clothes basket 2.

5 Claims, 5 Drawing Sheets

CLOTHES WASHER HAVING A PULSATOR APPARATUS

BACKGROUND OF THE INVENTION

1. Field of the Invention

The present invention relates to a clothes washer having a pulsator apparatus, and more particularly to a clothes washer having a pulsator apparatus in which a plurality of satellite pulsators are rotated by the rotation of a sun pulsator.

2. Description of the Prior Art

A clothes washer is generally classified into either a drum type in which a rotational shaft of a water basket is horizontally arranged, or an agitator type and a pulsator type in both of which a rotating shaft of a water basket is vertically arranged.

In the drum type clothes washer, a cylindrical drum having a plurality of water extracting openings is rotatably arranged in a water basket. During operation, a plurality of projections formed in the drum pull the clothes upward, and then clothes fall by gravity so the washing process is accomplished. This washer is adapted for larger capacity washing.

In the agitator type clothes washer, a rotatable agitator mounted at the center of the clothes washer is periodically rotated, and an agitating vane formed integrally on the side wall of the agitator stirs up water to form the swirling water. Clothes float in water and make frictional contact with the agitator and the inner wall of the clothes basket, thus accomplishing the washing process.

In the pulsator type clothes washer, a rotatable pulsator mounted at the center of the clothes washer is rotated so the flow of water swirls, thus executing a washing operation. This washer is widely utilized at the present.

FIG. 5 illustrates the typical pulsator type clothes washer. The clothes washer is comprised of a body B, a water basket 1 suspended to the body by the suspension device (not shown), and a clothes basket 2 mounted rotatably in the water basket 1. The clothes basket 2 comprises a plurality of openings 2E and a pulsator 3 rotatably mounted on the center of a bottom portion of the basket 2. Further, beneath the water basket 1 a motor 4 and a reduction gear assembly 5 are provided. The motor 4 generates the driving force, and the reduction gear assembly 5 reduces a high speed rotational force of the motor 4 into a proper speed rotational force for both the water basket 2 and the pulsator 3. The rotational force of the motor 4 is transmitted to the pulsator 3 and/or the water basket 2 by the selective engagement or disengagement of a clutch (not shown) housed in the reduction gear assembly. The pulsator 3 is connected with an input shaft 8 projected from the reduction gear assembly 5. The clockwise or counterclockwise rotational force of the pulsator 3 moves the clothes. Numeral 6 indicates a drain hose for draining water in the water basket 2, and Numerals 7A,7B are spray hoses, respectively, for spraying the pumped water from the pump onto the clothes put in the clothes basket 2. Numeral 11 designates a filter for lint in water supplied to the spray hose.

Single pulsator is mounted at the center of the inner bottom surface of the water basket, and the pulsator is coaxially arranged with the input shaft. The rotation of the input shaft causes the pulsator to rotate. The typical pulsator is revealed in U.S. Pat. Nos. 4,444,027 and 4,496,784. However, in this washer, the water flow generated by the pulsator is insufficiently transferred to the clothes floating beneath the level of water. Additionally, an ineffective water flow is provided to the side wall of the water basket. This causes inefficient washing in respect of clothes. Also the twisting and tangling of clothes may occur.

SUMMARY OF THE INVENTION

Therefore, it is an object of the present invention to provide a clothes washer having a pulsator apparatus for improving the washing efficiency of the washer.

It is another object of the present invention to provide a clothes washer having a pulsator apparatus for sufficiently performing the anti-twisting/tangling operation of clothes.

In order to achieve the above objects of the present invention, a clothes washer having a pulsator apparatus comprises a water basket, a clothes basket disposed in the water basket and including a first pulsator, a driving mechanism for selectively driving the clothes basket and the first pulsator, and a plurality of second pulsators driven by the rotating force of the first pulsator.

Further, the second pulsators are driven by a gear train which converts the rotating force of the first pulsator into mechanical force.

Furthermore, the gear train is comprised of a driving gear provided rotatably in the first pulsator, and a ring shape driven gear provided in the second pulsator and being meshed with the driving gear.

The gear train is further comprised of an idle gear formed along the tracks of the rotation of the driving gear and meshed with the driving gear.

Otherwise, the driving gear is comprised of a rubber wheel.

Further, the ring shape driven gear is comprised of a ring shape rubber pad.

Also, the idle gear is comprised of a ring shape rubber pad.

Alternatively, the second pulsators are driven by a second conversion means which converts the rotating force of the first pulsator into fluid force.

The second conversion means is comprised of a turbine.

A blade of the turbine is provided at a rotational shaft of the second pulsator.

BRIEF DESCRIPTION OF THE DRAWINGS

The above objects and other advantages of the present invention will be more clarified by describing a preferred embodiment thereof with reference to the accompanying drawings in which.

DESCRIPTION OF THE PREFERRED EMBODIMENT

Figure 1:
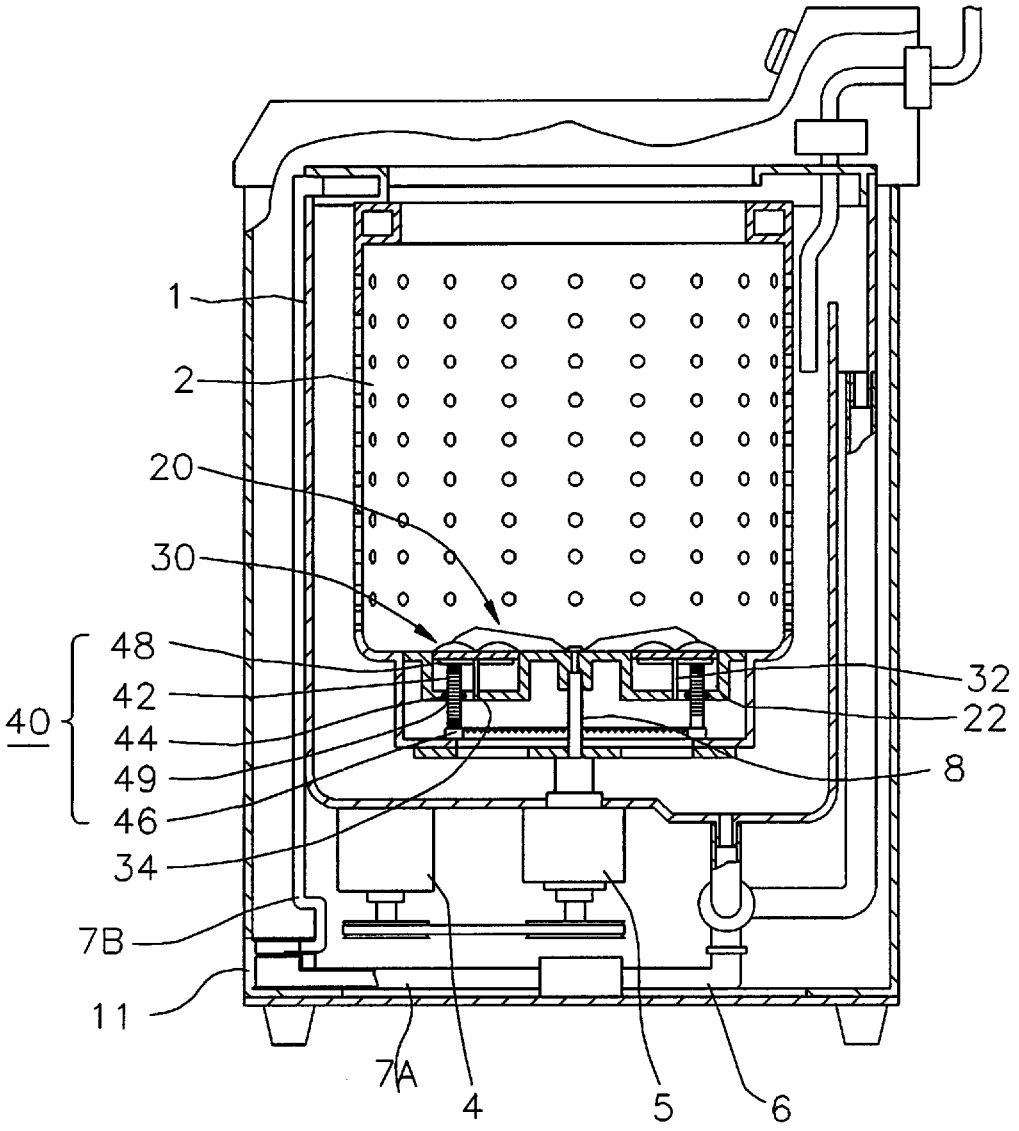
FIG. 1 is a vertical elevational view of a clothes washer having a pulsator apparatus according to the present invention.

Hereafter, the invention will be described in further detail with reference to the accompanying drawings. The component parts as those in FIGS. 1 through 4 are designated by the same reference numerals as the corresponding parts of conventional embodiment of FIG. 5, so a detailed description of those parts will be omitted.

Figure 2:
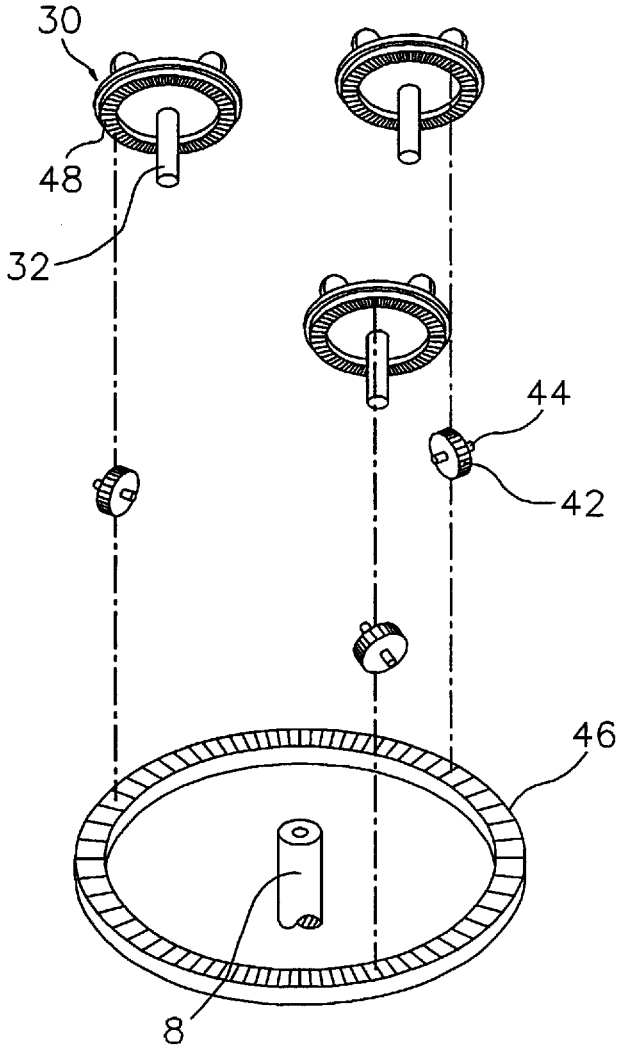
FIG. 2 is a plan view of the clothes washer having a pulsator apparatus shown in FIG. 1.

In the first embodiment as shown in FIGS. 1 and 2, a driving or first pulsator 20 is rotatably mounted at the input shaft 8 of the reduction gear assembly 5 which is disposed at the central lower portion of the clothes basket 2. In the first pulsator 20, a plurality of second pulsators 30 are rotatably provided in a predetermined space. Further, a gear train is provided for transmitting the rotational force of the first pulsator 20 to the second pulsator 30.

A plurality of recesses 22 are formed on the upper surface of the first pulsator 20. A bearing hole 34 is provided at the central portion of the bottom of the recess 22 for enabling the shaft 32 of the second pulsator 30 to rotate. Further, a slot 49 is formed at the bottom portion of the recess 22 and permits a driving gear 42 of the gear train 40 to freely drive, the driving gear being explained later.

The gear train 40 is comprised of a driving gear wheel 42 receiving the rotation force of the first pulsator 20 and a driven gear 48 meshed with the driving gear wheel 42. The gear train 40 further is comprised of an idle gear 46 formed along the tracks of the rotation of the driving gear around the shaft 8.

In the driving gear wheel 42, both ends of the shaft 44 of the gear wheel 42 are rotatably inserted into both sides of the slot 49, respectively. The idle gear 46 is provided on the upper surface of the bottom portion of the clothes basket and is formed as a ring gear meshed with the driving gear wheel 42. The driven gear 48 is provided underneath the second pulsator 30 and is formed as a ring gear around the shaft 32.

Alternatively, the driving gear wheel 42 can be substituted with a rubber wheel, the driven gear 48 can be substituted with a ring shape rubber pad, and the idle gear can be substituted with a rubber pad.

Figure 3:
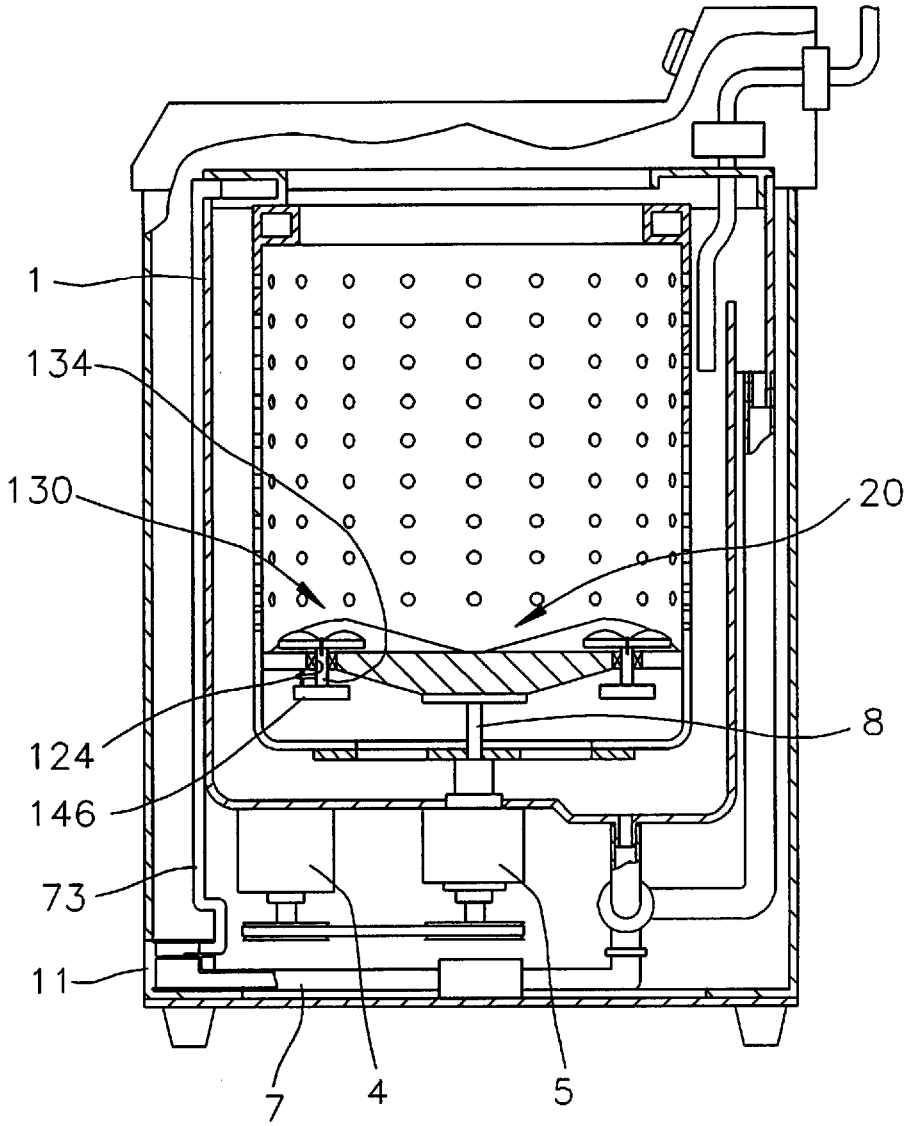
FIG. 3 is a vertical elevational view of a clothes washer having a pulsator apparatus as another embodiment according to the present invention.
Figure 4:
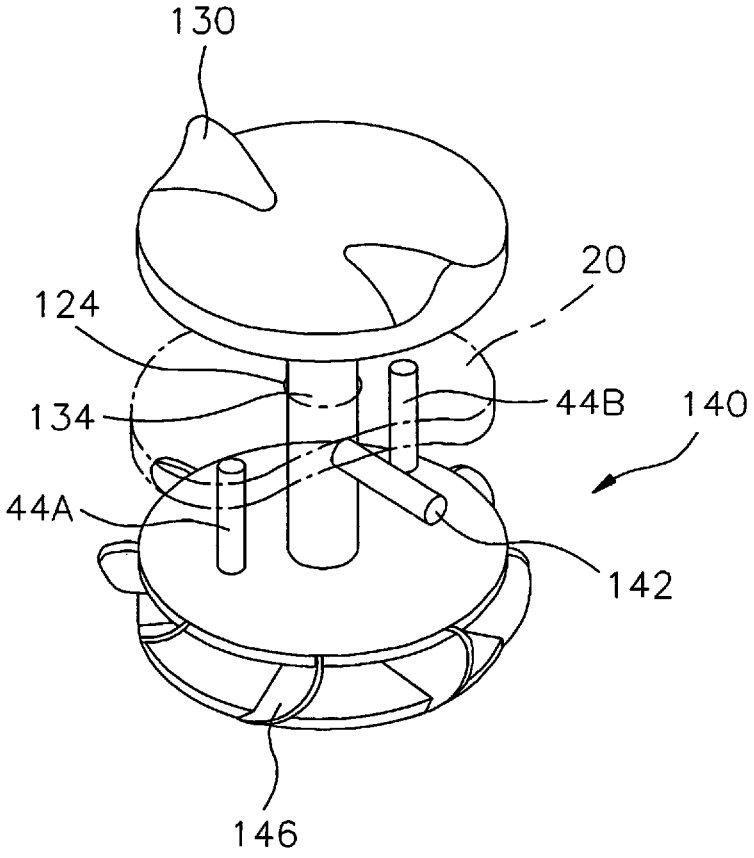
FIG. 4 is a plan view of the clothes washer having a pulsator apparatus shown in FIG. 3.
Figure 5:
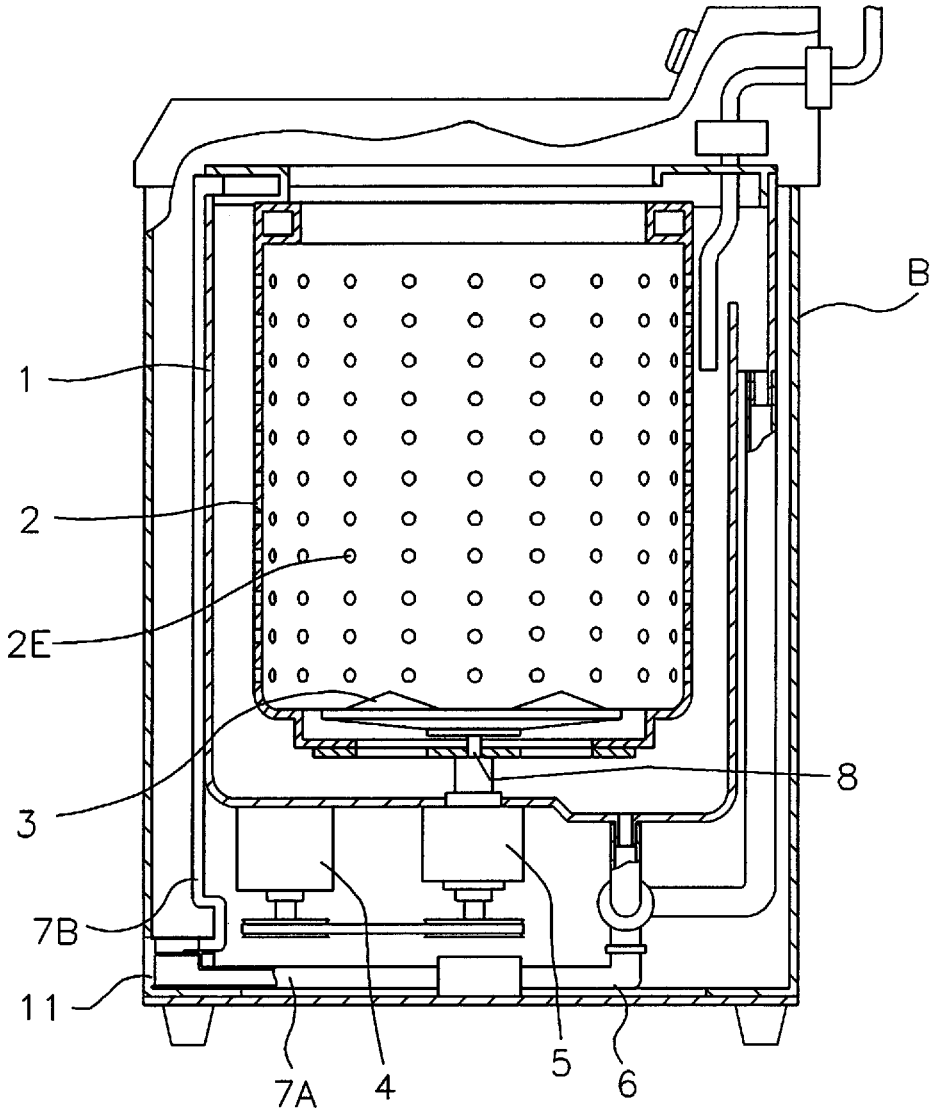
FIG.5 PRIOR ART
FIG. 5 is a vertical elevational view of the clothes washer having a pulsator apparatus according to a prior art.

In FIGS. 3 and 4 illustrating a second embodiment, a driving or first pulsator 20 is rotatably mounted at the input shaft 8 of the reduction gear assembly 5 which is disposed at the central lower portion of the clothes basket 2. In the first pulsator 20, a plurality of second pulsators 130 are rotatably provided in.a predetermined space. A shaft 134 of respective second pulsator 130 is extended downward through a bearing hole 124 of the second pulsator 130. At the lower portion of the shaft 134 is provided a turbine 140 which rotates the second pulsator 130 by the swirl of washing water.

The turbine 140 is provided between the bottom portion of the clothes basket 2 and the first pulsator 20, and is rotated by the swirling water with respect to the rotation of the first pulsator 2. The turbine 140 is comprised of a plurality of blades 146 formed at the lower end of the shaft 134 of the second pulsator 132, a protrudor 142 extending traversally from the middle portion of the shaft 134, and a couple of stoppers 44A,44B for restricting the rotation of the protrudor 142. The stoppers are extended downward from the lower surface of the first pulsator 20.

The clothes washer having the pulsator apparatus according to the present invention constructed as above is operated as below.

The washing mode starts according to a predetermined program, then the operating force of the motor 4 is transmitted to the reduction gear assembly 5. The input shaft 8 of the reduction gear assembly 5 rotates, and then the first pulsator 20 rotates. Like the rotation of the first pulsator 20, respective driving gear wheels 42 move simultaneously along on the idle gear 46. Thus, the driven gear 48 meshed with the driving gear wheel 42 rotates. The swirling water flow created by the rotation of each second pulsator 30 is combined with another swirling water flow for the first pulsator 20, which results in a greater swirling water flow.

On the other hand, in another embodiment, the swirling water flow created by the rotation of the first pulsator 20 makes the turbine rotate. Thus, the shaft 134 connected to the turbine 140 rotates the second pulsator 130. The second pulsator 130 rotates respectively to the first pulsator 20 irrespective of the rotation of the first pulsator 20, thereby resulting in various swirling water flows.

Further, the rotational range of the protrudor 142 is restricted by the stopper 44A,44B during the rotation of the second pulsator 130. The second pulsator 130 rotating in the limited range rotates simultaneously along the rotation of the first pulsator 20. The resistant force of the water flow is applied to the stationary second pulsator 130 when the water impulse is directed onto the second pulsator 130. Thus, the flow direction of the water is changed due to the resistant force of the second pulsator 130, thereby resulting in various swirling water flows.

According to the present invention as described above, since a plurality of driven pulsators are arranged along the inner circumference of the driving pulsator disposed in the clothes basket, and the driven pulsators rotate according to the rotation of the driving pulsator, the driving pulsator and a plurality of driven pulsators generate a greater swirling water flow during the washing mode, resulting in higher washing efficiency.

Furthermore, since clothes in the basket are agitated by a plurality of pulsators, twisting and tangling of the clothes is prevented.

What is claimed:

1. A clothes washer having a pulsator apparatus comprising:

a water basket;

a clothes basket disposed in said water basket and including a first pulsator;

a driving mechanism for selectively driving said clothes basket and said first pulsator; and a plurality of second pulsators driven by a gear train which converts a rotating force of said first pulsator into mechanical force.

2. The clothes washer having a pulsator apparatus according to claim 1, wherein said gear train is comprised of a driving gear provided rotatably in said first pulsator, and a ring shape driven gear provided in said second pulsator and being meshed with said driving gear.

3. The clothes washer having a pulsator apparatus according to claim 1, wherein said gear train is further comprised of an idle gear formed along the tracks of the rotation of said driving gear and meshed with said driving gear.

4. A clothes washer having a pulsator apparatus comprising:

a water basket;

a clothes basket disposed in said water basket and including a first pulsator;

a driving mechanism for selectively driving said clothes basket and said first pulsator;

a plurality of second pulsators driven by rotation of a plurality of blades which are rotated by water current flow formed by a rotation of said first pulsator, said blade provided at a rotational shaft of said second pulsator; and a rotation restrictor for the rotation of said second pulsator.

5. The clothes washer having a pulsator apparatus according to claim 4, wherein said rotation restrictor comprises a protrudor extended traversally from said rotational shaft, and a stopper extended downward from a lower surface of said first pulsator.

* * * * *